US007505003B2

(12) United States Patent
Kakinoki et al.

(10) Patent No.: US 7,505,003 B2
(45) Date of Patent: Mar. 17, 2009

(54) CARD DEVICE WITH ANTENNA FEED TERMINAL

(75) Inventors: Wataru Kakinoki, Yokohama (JP); Yasutaka Maekawa, Sagamihara (JP); Noboru Morioka, Sagamihara (JP)

(73) Assignee: Murata Manufacturing Co., Ltd. (JP)

( * ) Notice: Subject to any disclaimer, the term of this patent is extended or adjusted under 35 U.S.C. 154(b) by 53 days.

(21) Appl. No.: 10/576,591

(22) PCT Filed: Aug. 31, 2004

(86) PCT No.: PCT/JP2004/012560

§ 371 (c)(1),
(2), (4) Date: Jan. 16, 2007

(87) PCT Pub. No.: WO2005/043673

PCT Pub. Date: May 12, 2005

(65) Prior Publication Data

US 2007/0139279 A1 Jun. 21, 2007

(30) Foreign Application Priority Data

Nov. 4, 2003 (JP) ..... 2003-374568

(51) Int. Cl.
*H01Q 1/24* (2006.01)

(52) U.S. Cl. ..... 343/702

(58) Field of Classification Search ..... 343/702, 343/761, 895

See application file for complete search history.

(56) References Cited

U.S. PATENT DOCUMENTS 4,920,350 A * 4/1990 McGuire et al. ..... 343/709

(Continued)

FOREIGN PATENT DOCUMENTS

JP 64-45141 3/1989

(Continued)

OTHER PUBLICATIONS

International Search Report PCT/JP2004/012560 dated Oct. 12, 2004.

(Continued)

*Primary Examiner*—Huedung Mancuso
(74) *Attorney, Agent, or Firm*—Ostrolenk, Faber, Gerb & Soffen, LLP

(57) ABSTRACT

A card device includes a card case, a circuit board disposed in the card case, and an antenna rotatably disposed on the outside of the card case. An antenna rotating shaft is disposed on the base end of the antenna and inserted from the outside into the inside of the card case through a through-hole of the card case such that the antenna rotating shaft extends along the surface of the circuit board and is supported within the card case with the inner part of the antenna rotating shaft being spaced apart from the circuit board and the antenna rotating shaft being freely rotatable. A feed terminal having elasticity that urges the feed terminal against the antenna rotating shaft is disposed between the antenna rotating shaft and a part of the circuit board facing the antenna rotating shaft. The feed terminal is fixed to an antenna connection part of a circuit formed on the circuit board facing the antenna rotating shaft. The feed terminal is urged by its elasticity into contact with the antenna rotating shaft.

5 Claims, 3 Drawing Sheets

U.S. PATENT DOCUMENTS

| | | | | |
|---|---|---|---|---|
| 5,696,519 | A * | 12/1997 | Suzuki et al. | 343/761 |
| 6,414,638 | B1 * | 7/2002 | Egashira | 343/702 |
| 6,813,481 | B1 * | 11/2004 | Ide | 455/129 |
| 6,993,297 | B2 * | 1/2006 | Smith, Jr. | 455/82 |

FOREIGN PATENT DOCUMENTS

| | | |
|---|---|---|
| JP | 09-162622 | 6/1997 |
| JP | 10-13287 | 1/1998 |
| JP | 10-163723 | 6/1998 |
| JP | 10-224046 | 8/1998 |
| JP | 2000-252719 | 9/2000 |
| JP | 2001-69029 | 3/2001 |
| JP | 2001-284932 | 10/2001 |
| JP | 2001-339211 | 12/2001 |
| JP | 2002-9519 | 1/2002 |
| JP | 2002-374111 | 12/2002 |

OTHER PUBLICATIONS

Japanese Examination Report dispatched Jul. 11, 2006 with English Language translation.

* cited by examiner

CARD DEVICE WITH ANTENNA FEED TERMINAL

CROSS-REFERENCE TO RELATED APPLICATION

The present application is a 35 U.S.C. §371 national phase conversion of PCT/JP2004/012560 filed Aug. 31, 2004, which claims priority of Japanese application no. JP2003-374568 filed Nov. 4, 2003, which are incorporated herein in their entirety.

BACKGROUND OF THE INVENTION

1. Technical Field

The present invention relates to a card device with an antenna feed terminal for use attached to an electronic device such as a personal computer.

2. Background Art

FIG. 4 shows, in the form of a simplified schematic diagram, an example of the external appearance of a known card device. The card device 41 includes a card case 42, a circuit board 43 disposed inside the card case 42, and an antenna 44 disposed rotatably on the outside of the card case 42 and electrically connected to the circuit board 43.

An antenna rotating shaft 45 is formed of a conductive material on the base end of the antenna 44. In a side wall of the card case 42, there is formed a through-hole for inserting the antenna rotating shaft 45 from the outside into the inside of the card case 42. The antenna rotating shaft 45 inserted via the through-hole from the outside in the inside of the card case 42 is electrically connected to a circuit disposed on the circuit board 43, and thus the antenna 44 is electrically connected to the circuit of the circuit board 43 via the antenna rotating shaft 45.

Because the antenna rotating shaft 45 rotates, it is not desirable to connect the antenna rotating shaft 45 directly to the circuit board 43. If the antenna rotating shaft 45 is directly connected to the circuit board 43, various problems can occur. To avoid these problems, it has been proposed to use a feed terminal 46 such as that shown, in the form of a cross-sectional view, in FIG. 5 to electrically connect the antenna rotating shaft 45 to the circuit of the circuit board 43 (refer to, for example, Japanese Unexamined Patent Application Publication No. 2001-339211). See also Japanese Unexamined Patent Application Publication No. 2002-374111.

In the example shown in FIG. 5, the feed terminal 46 is formed of an electrically conductive material, and includes a connection part 46A for contact connection with the antenna rotating shaft 45, and a circuit connection part 46B for contact connection with a circuit-to-antenna connection land 47 formed on the surface of the circuit board 43. In this structure, the antenna rotating shaft 45 is in contact with connection part 46A of the feed terminal 46, and the circuit connection part 46B of the feed terminal 46 is in contact with the antenna connection land 47 of the circuit board 43, and thus the antenna 44 is electrically connected to the circuit of the circuit board 43 via the antenna rotating shaft 45 and the feed terminal 46. In FIG. 5, reference numeral 48 denotes an interconnection pattern that connects the antenna connection land 47 to a part of the circuit, such as a high frequency circuit part for wireless communication (not shown).

If the antenna rotating shaft 45 is electrically connected to the circuit of the circuit board 43 by using the feed terminal 46 such as that shown in FIG. 5, the following problems can occur. The feed terminal 46 has a structure in which the part 46A in contact with the antenna rotating shaft 45 and the part 46B in contact with the antenna connection land 47 of the circuit board 43 are located side by side when viewed from the upper side of the circuit board 43. This structure of the feed terminal 46, in which the part 46A for connection with the antenna rotating shaft and the part 46B for connection with the circuit are located side by side, makes it difficult to reduce the installation space for the feed terminal 46 on the card device 41. Besides, to ensure high reliability in terms of connection with the antenna rotating shaft 45 or the antenna connection land 47, it is required that the part 46A for connection with the antenna rotating shaft and the part 46B for connection with the circuit should each have a sufficiently large size, and thus it is difficult to reduce the installation space for the feed terminal 46 in the card device 41.

When a signal is transmitted between the antenna 44 and the circuit of the circuit board 43, the signal has to pass through two contacts, that is, the contact between the antenna rotating shaft 45 and the part 46A, for connection with the antenna rotating shaft, of the feed terminal 46, and the contact between the antenna connection land 47 of the circuit board 43 and the circuit connection part 46B of the feed terminal 46. Because the respective two electric conductors are simply placed in contact with each other at each of these two points, a signal transmission loss can occur, and, at worst, even a connection failure can occur. This can result in reduction in reliability of the wireless communication capability provided by the card device 41. Although reliability in terms of connection between the feed terminal 46 and the antenna connection land 47 can be improved by plating the surface of the antenna connection land 47 with gold or the like, the result is an increase in cost.

SUMMARY OF THE INVENTION

The present invention provides a card device which needs only a small installation space for a feed terminal that connects an antenna to a circuit on a circuit board, which has high reliability in terms of electrical connection (signal transmission) between the antenna and the circuit on the circuit board, has high resistance to a mechanical shock applied from the outside, and can be produced easily.

According to one advantageous feature of the invention, a card device comprises a card case formed by combining an upper cover and a lower cover, a circuit board disposed in the inner space of the card case, and an antenna rotatably disposed on the outside of the card case and electrically connected to a circuit formed on the circuit board. A through-hole is formed in a side wall of the card case, for inserting an antenna rotating shaft formed of a conductive material on the base end of the antenna from the outside into the inside of the card case in a direction along the surface of the circuit board. A part for supporting the antenna rotating shaft is formed on the inner wall surface of the card case such that an inner portion of the antenna rotating shaft, which is inserted through the through-hole into the inside of the card case, is supported within the card case in such a manner that the inner portion of the antenna rotating shaft is spaced apart from the circuit board and is freely rotatable. A feed terminal having elasticity is disposed between the inner portion of the antenna rotating shaft and an area of the circuit board that faces the inner portion of the antenna rotating shaft, such that the elasticity of the feed terminal provides an urging force against the inner portion of the antenna rotating shaft. The feed terminal is fixed to an antenna connection part of the circuit formed in the area of the circuit board that faces the antenna rotating shaft, such that the feed terminal is electrically connected to the circuit on the circuit board, and the feed terminal is urged by the elastic urging force so as to be maintained in conductive contact with the antenna rotating shaft.

According to this feature of the present invention, the feed terminal is disposed between the circuit board and the inner portion of the antenna rotating shaft, which is supported so as to be spaced apart from the circuit board. The feed terminal is urged by the urging force of its elasticity so as to be maintained in conductive contact with the antenna rotating shaft. The feed terminal is fixed to the antenna connection part of the circuit formed in the area of the circuit board that faces the antenna rotating shaft. Thus, the mechanical fixing of the feed terminal to the circuit board and the electrical connection of the feed terminal to the circuit on the circuit board are achieved at the same location. In addition, the feed terminal is in contact with the antenna rotating shaft at the position above the position at which the feed terminal is connected to the circuit on the circuit board. This structure allows a reduction in the installation space required for the feed terminal in the card device, as compared with the structure in which the part for connection with the antenna rotating shaft and the part for connection with the circuit are located side by side.

When the feed terminal is fixed via solder or the like to the antenna connection part of the circuit on the circuit board, the electrical signal path between the antenna and the circuit of the circuit board includes only one simple conductor-to-conductor contact, that is, a contact without solder or the like, namely the contact between the feed terminal and the antenna rotating shaft. The reduction in the number of simple conductor-to-conductor contacts included in the electrical signal path suppresses the probability of a contact failure occuring and also suppresses the signal transmission loss at the contact. As a result, it is possible to achieve high reliability in terms of the electrical connection (signal transmission) between the antenna and the circuit of the circuit board, and thus the card device has high reliability in terms of wireless communication capability.

Another feature of the present invention is that the connection between the feed terminal and the antenna connection part is not made by simply placing in contact the feed terminal and the antenna connection part, such as a land formed on the circuit board, but instead is achieved by fixing, using solder or the like, the feed terminal to the antenna connection part. This makes it unnecessary to plate the surface of the antenna connection part with gold, which is necessary in the simple conductor-to-conductor contact to improve reliability in terms of connection between the feed terminal and the antenna connection part (such as the land). This allows the card device to be produced at a reduced cost.

The feed terminal can be fixed to the circuit board by soldering at the same time when other electronic parts are soldered to the circuit board. That is, it is possible to fix the feed terminal to the circuit board without having to perform a troublesome process such as screwing, and thus the production process of the card device can be simplified. This allows a reduction in the production cost of the card device.

Because the antenna rotating shaft is supported by the side wall of the card case and the part for supporting the antenna rotating shaft disposed on the inner wall surface of the card case, when an impactive force is applied to the antenna and thus an external stress is applied to the antenna rotating shaft, the external stress applied to the antenna rotating shaft can be relieved to the card case via the side wall of the card case or via the part for supporting the antenna rotating shaft. Because the feed terminal in contact with the antenna rotating shaft is elastic, when an external stress is applied to the feed terminal via the antenna rotating shaft, the external stress is absorbed by the elasticity of the feed terminal and thus the external stress is prevented from being applied to the circuit board via the feed terminal. That is, the structure according to the present invention prevents an external stress applied to the antenna from being transferred to the circuit board. This prevents the feed terminal from coming off the circuit board.

Even when the antenna rotating shaft is deformed to a certain degree by an external stress, the elasticity of the feed terminal allows it to maintain the contact between the antenna rotating shaft and the feed terminal. Thus, the card device has high resistance against an external impact.

In another feature of the present invention, the feed terminal is urged into contact with the inner part of the antenna rotating shaft located between the part for supporting the antenna rotating shaft and the side wall of the card case in which the through-hole for inserting the antenna rotating shaft is formed. That is, the feed terminal is urged into contact with the inner part of the antenna rotating shaft which is supported at both ends by the side wall of the card case and the part for supporting the antenna rotating shaft.

This results in an increase in mechanical strength of the card device.

Another aspect of the invention provides an antenna rotation position holding arrangement for holding the rotation adjustment position of the antenna, which makes it possible to hold the antenna at an intended position at which the antenna is set by rotation.

In the disclosed structure, the circuit board is fixed to the lower cover, the antenna rotating shaft is rotatably supported to the inner surface of the upper cover, and the upper cover and the lower cover are combined together into the final form of the card case. When the upper cover and the lower cover are combined, the feed terminal of the circuit board fixed to the lower cover is urged into contact with the antenna rotating shaft supported by the upper cover. That is, in the production process, the feed terminal is urged into contact with the antenna rotating shaft simply by combining the upper cover and the lower cover without having to perform a troublesome process to adjust the installation position of the antenna rotating shaft with respect to the feed terminal so that the feed terminal is urged into contact with the antenna rotating shaft. This makes it easy to produce the card device.

In this structure, a hook on the extending wall formed on one of the upper cover and the lower cover is engaged with a hook accepting part formed on the other cover whereby the upper cover and the lower comer are combined together. That is, the upper cover and the lower cover can be easily combined together without having to perform a troublesome process such as screwing. This makes it possible to easily produce the card device. Because the upper cover and the lower cover are assembled mechanically, the upper cover and the lower cover are firmly combined together such that the upper cover and the lower cover are not easily separated. That is, the resultant card case has high mechanical strength.

In a structure in which the feed terminal of the circuit board fixed to the lower cover is urged into contact with the antenna rotating shaft by combining the upper cover and the lower cover, if the connection between the upper cover and the lower cover becomes loose due to degradation in the connection, the urging force that urges the feed terminal into contact with the antenna rotating shaft can disappear. In contrast, in another structure in which a hook of the extending wall formed on one of the upper cover and the lower cover is firmly engaged with a hook accepting part formed on the other cover, the upper cover and the lower comer are firmly combined mechanically. This prevents the urging force which urges the feed terminal into contact with the antenna rotating shaft from disappearing, which can occur when the non-hook connection between the upper cover and the lower cover becomes loose due to degradation in the connection.

Other features and advantages of the present invention will become apparent from the following description of embodiments of invention which refers to the accompanying drawings.

DETAILED DESCRIPTION OF AN EMBODIMENT OF THE INVENTION

Reference Numerals

Figure 1:
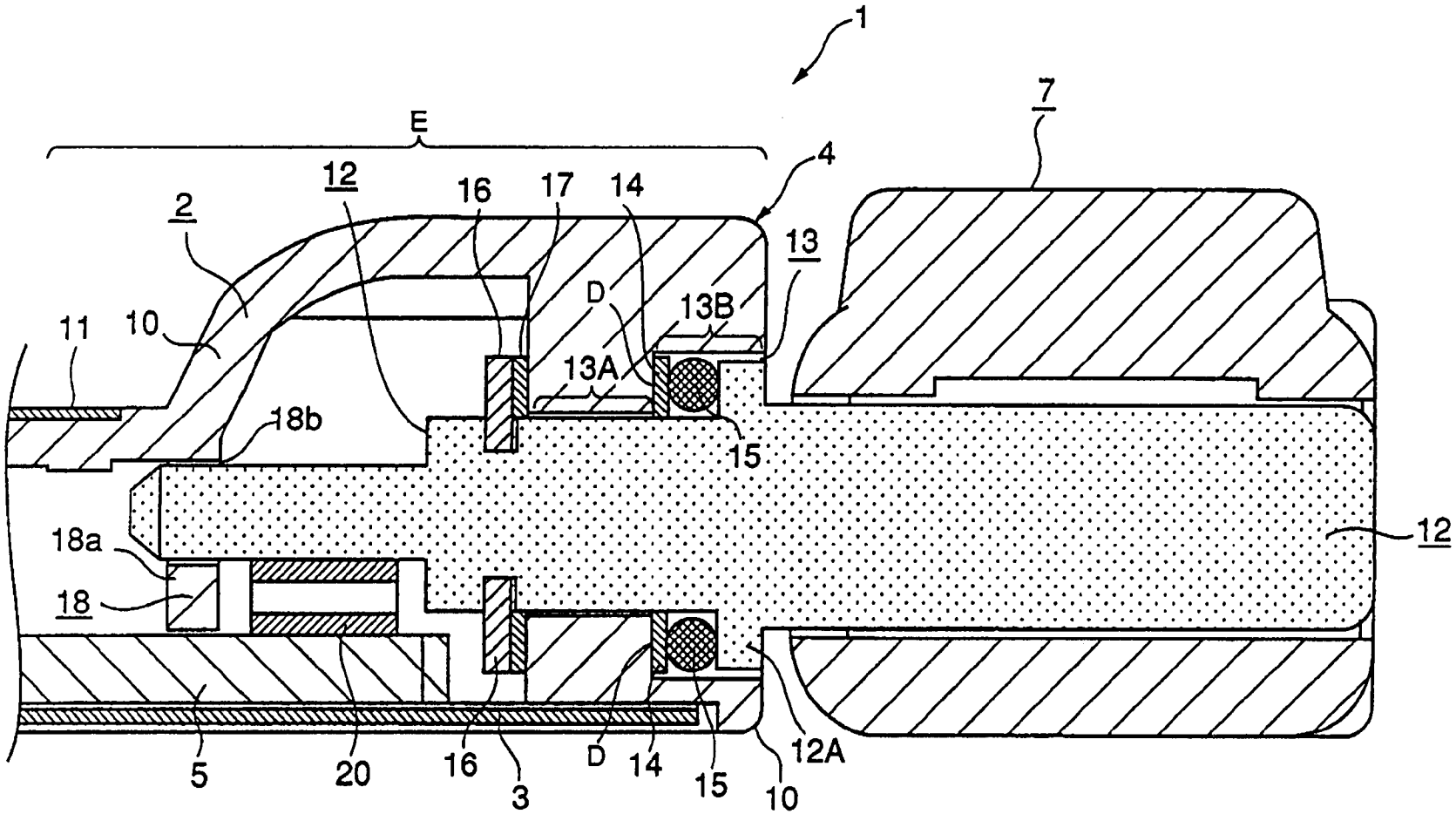
FIG. 1 is a cross-sectional view partially showing a card device according to an embodiment of the present invention, wherein only parts related to the embodiment of the invention are shown.

1: card device
2: upper cover
3: lower cover
4: card case
5: circuit board
7: antenna
12: antenna rotating shaft
13: through-hole
18: part for supporting the antenna rotating shaft
20: feed terminal Embodiments of the present invention are described below with reference to the drawings.

Figure 2:
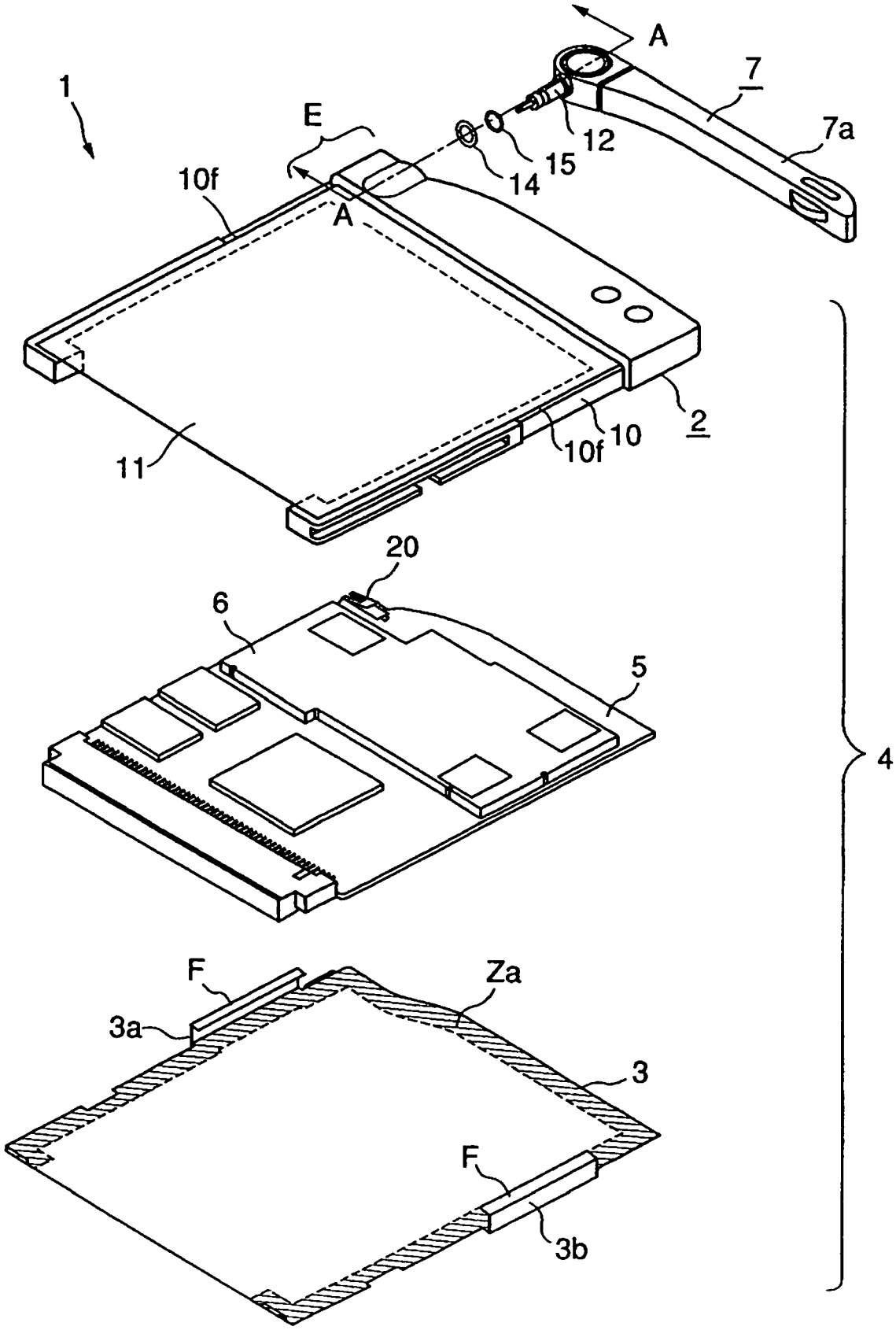
FIG. 2 is an exploded view showing a card device, according to the disclosed embodiment of the present invention.

In an embodiment, as shown in the form of an exploded perspective view in FIG. 2, a card device includes a card case 4 formed by combining an upper cover 2 and a lower cover 3, a circuit board 5 disposed in an internal space of the card case 4, and an antenna 7 rotatably disposed on the outside of the card case 4 and electrically connected to a circuit 6 formed on the circuit board 5. For example, this card device 1 is used in a state in which the card device 1 is inserted in a card insertion slot of an electronic device such as a personal computer (a specific example of the card device 1 is a CF card). The card device 1 is of an extending type and has an extending part E that extends outward from a card insertion slot of an electronic device when the card device 1 is inserted into the card insertion slot. Note that "CF (Compact Flash)" is a trademark registered in Japanese Patent Office.

The upper cover 2 includes a frame 10 and a panel 11 which are constructed in an integrated form. The frame 10 is made of, for example, a plastic material, and the panel 11 is made of, for example, a metal plate. The lower cover 3 is made of, for example, a metal plate and has extending walls 3*a* and 3*b* extending along the outer wall surface of the upper cover 2 (that is, along the outer wall surface of the frame 10). The end portion of each of the extending walls 3*a* and 3*b* is bent so as to function as a hook F. The upper cover 2 has a hook accepting part 10*f* for accepting the hook F.

In the present embodiment, the bottom surface of the frame 10 of the upper cover 2 is connected, via an adhesive or a double-faced adhesive tape, to the edge portion (for example, a portion 7*a* shaded with diagonal lines in FIG. 2) of the lower cover 3, and the hook F of the lower cover 3 is hooked with the hook accepting part 10*f* of the upper cover 2 thereby combining the upper cover 2 and the lower cover 3 and thus forming the card case 4.

The circuit board 5 is placed in the inner space of the card case 4 formed by combining the upper cover 2 and the lower cover 3 and is fixed to the lower cover 3 by using an adhesive or a double-sided adhesive tape or by means of thermo-compression bonding.

The antenna 7 includes a protective case 7*a* made of, for example, a plastic material and a main antenna part (not shown) placed in the protective case 7*a* and serving to transmit and receive radio waves. On the base end of the antenna 7, there is formed an antenna rotating shaft 12 of a conductive material electrically connected to the main antenna part.

FIG. 1 is a cross-sectional view taken along line A-A of FIG. 2. As shown in FIG. 1, the upper cover 2 has a through-hole 13 formed through the side wall of the extending part E of the frame 10. The through-hole 13 is for inserting the antenna rotating shaft 12 from the outside into the inside of the card case in a direction along the surface of the circuit board 5. The through-hole 13 includes a fitting part 13A through which the antenna rotating shaft 12 is inserted with substantially no gap and a greater-diameter part 13B with a diameter greater than the diameter of the fitting part 13A. The fitting part 13A is located at a more inner position and the greater-diameter part 13B is located outwardly adjacent to the fitting part 13A.

In the greater-diameter part 13B of the through-hole 13, there are provided a washer 14 and an O-ring 15. The washer 14 is disposed in contact with a step D formed at the boundary between the greater-diameter part 13B and the fitting part 13A, and the O-ring 15 is disposed in contact with the washer 14. The washer 14 and the O-ring 15 have forms that allow the antenna rotating shaft 12 to pass through them.

On the base end of the antenna rotating shaft 12, there is formed a protruding part 12A fitted into the greater-diameter part 13B of the through-hole 13. To insert the antenna rotating shaft 12 into the through-hole 13, the antenna rotating shaft 12 is first inserted through the O-ring 15 and the washer 14, and then the antenna rotating shaft 12 is inserted together with the O-ring 15 and the washer 14 into the through-hole 13 from the outside of the card case 4. In the present embodiment, the insertion of the antenna rotating shaft 12 is stopped when the washer 14 is brought into contact with the step D in the through-hole 13, the O-ring 15 is brought into contact with the washer 14, and the protruding part 12A of the antenna rotating shaft 12 is brought into contact with the O-ring 15. To maintain this state without allowing the antenna rotating shaft 12 to move out of the through-hole 13, a washer 17 is attached to the antenna rotating shaft 12 from the inside of the card case 4 and then an E-ring 16 is fitted onto the antenna rotating shaft 12. The E-ring 16 is stopped, via the washer 17, by the opening end edge of the through-hole 13 inside the card case 4, thereby preventing the antenna rotating shaft 12 from moving out of the through-hole 13. By using the through-hole 13, the washers 14 and 17, the O-ring 15, and the E-ring 16 in the above-described manner, the antenna rotating shaft 12 is held to the upper cover 2 in a state in which the antenna rotating shaft 12 is freely rotatable.

In the present embodiment, the O-ring 15 and the protruding part 12A of the antenna rotating shaft 12 form antenna rotation position holding means for holding the rotation adjustment position of the antenna 7 by friction that occurs at a contact interface between the O-ring 15 and the protruding part 12A. A lubricant is coated on the surface of the O-ring 15 to adjust the frictional force between the O-ring 15 and the protruding part 12A of the antenna rotating shaft 12 such that the rotation adjustment position of the antenna 7 is held while allowing the antenna 7 to rotate smoothly.

In the present embodiment, the washer 14 is disposed between the O-ring 15 and the step D formed in the through-hole 13, and the washer 17 is disposed between the E-ring 16 and the opening end edge (the inner side wall of the frame 10), on the inner side of the card case 4, of the through-hole 13. These washers 14 and 17 reduce friction between the O-ring 15 and the step D of the through-hole 13 and friction between the E-ring 16 and the inner side wall of the frame 10 thereby minimizing a reduction in life-time of parts such as the frame 10, the O-ring 15, and the E-ring 16 due to the friction.

A part 18 for supporting the antenna rotating shaft is formed on the inner surface of the upper cover 2, at a location corresponding to the end part of the antenna rotating shaft 12. In the present embodiment, the part 18 for supporting the antenna rotating shaft has a protruding part 18*a* protruding inward in the inside of the card case 4 from the inner surface of the frame 10, and a hole 18*b* for inserting the antenna rotating shaft is formed in the protruding part 18*a*. The end portion of the antenna rotating shaft 12 is inserted in the hole 18*b* thereby supporting the antenna rotating shaft 12 to the upper cover 2 (the frame 10) while maintaining the antenna rotating shaft 12 apart from the circuit board 5.

In the present embodiment, a feed terminal 20 made of an elastic electrically conductive material is disposed between the circuit board 5 and an inner portion of the antenna rotating shaft. The inner portion of the antenna rotating shaft in this embodiment is its portion between the side wall of the frame 10 in which the through-hole 13 is formed and the part 18 for supporting the antenna rotating shaft. The feed terminal 20 is formed as shown in the form of a perspective view in FIG. 3, and the feed terminal 20 has elasticity that causes the feed terminal 20 to be urged against the antenna rotating shaft 12.

On the circuit board 5, an antenna connection land (not shown) for a connection between the antenna and the circuit 6 of the circuit board 5 is formed in an area where the feed terminal 20 is placed (that is, the area facing the antenna rotating shaft 12). The feed terminal 20 is connected to the antenna connection land, for example, by means of soldering such that the feed terminal 20 is mechanically fixed to the circuit substrate 5 and electrically connected to the circuit 6 of the circuit board 5.

In the present embodiment, as described above, the circuit board 5 is fixed to the lower cover 3 and the antenna rotating shaft 12 is attached to the upper cover 2. The upper cover 2, to which the antenna rotating shaft 12 is attached, is combined with the lower cover 3 to which the circuit board 5 is fixed, such that the feed terminal 20 fixed to the circuit board 5 is urged against the antenna rotating shaft 12 and brought into contact with the antenna rotating shaft 12.

Figure 3:
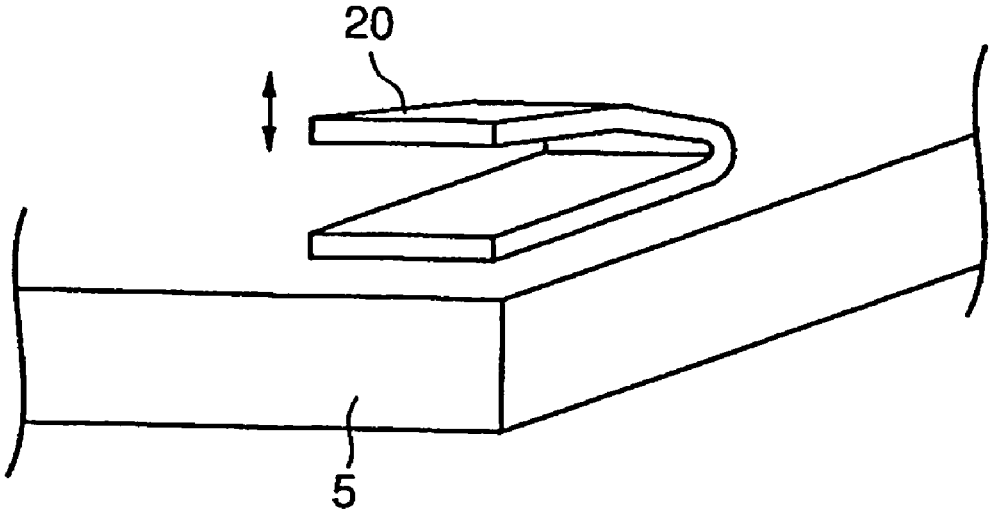
FIG. 3 is a diagram showing an example of a feed terminal for use in the card device shown in FIG. 1 or 2.
Figure 4:
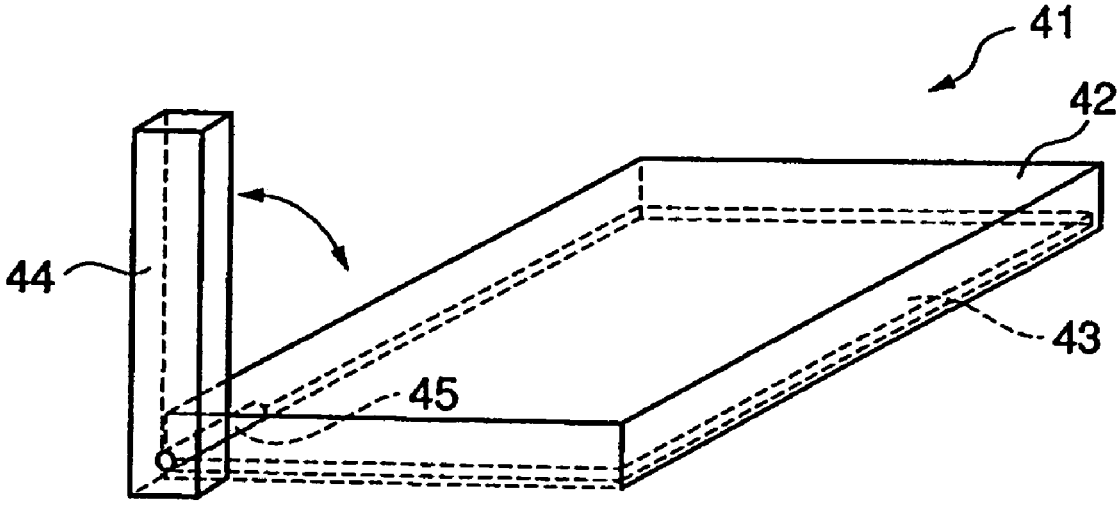
FIG. 4 is a diagram showing, in a simplified fashion, an example of the external appearance of a known card device.
Figure 5:
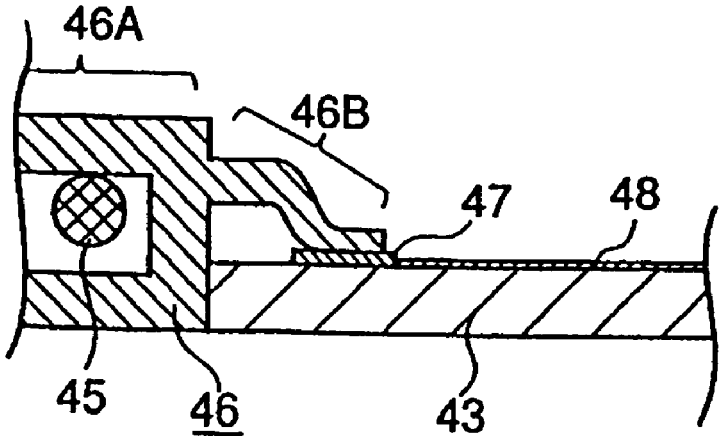
FIG. 5 is a diagram showing an example of a structure for electrically connecting an antenna rotating shaft to a circuit of a circuit board via a feed terminal in a known card device.

A part called a ground terminal and having a structure similar to that of the feed terminal 20 shown in FIG. 3 is commercially available. Such a ground terminal may be used instead of using the feed terminal 20 designed and produced for dedicated use in the card device 1. When the commercially available ground terminal is used as the feed terminal 20, it is not necessary to design the feed terminal 20 and it is also not necessary to do a troublesome job to produce the feed terminal 20 using an expensive mold. Thus, it is possible to reduce the cost of the card device 1.

Note that the present invention is not limited to the embodiment described above, but the present invention can be embodied in various ways. For example, although in the embodiment described above, the card device 1 is of the extending type, the present invention may also be applied to a card device having no extending part E.

In the embodiment described above, the upper cover 2 is formed by the frame 10 made of a plastic material and the panel 11 made of a metal material. Alternatively, for example, the upper cover 2 may be formed of a plastic material (for example, an amorphous plastic material such as polycarbonate) into the same shape as the total shape including the frame 10 and the panel 11 by using an integral molding technique.

In the embodiment described above, the means for holding the antenna rotation position is realized using the O-ring 15. Alternatively, instead of using the O-ring 15, a lock washer may be disposed in that location and the rotation adjustment position of the antenna 7 may be held by using friction between the lock washer and the protruding part 12A of the antenna rotating shaft 12. A spring or the like may also be used to realize the means for holding the rotating adjustment position of the antenna. Moreover, the feed terminal 20 itself tends to resist rotation of the antenna rotation shaft 12. As described above, the mechanism of holding the rotation adjustment position of the antenna 7 can be realized in various ways.

Although the feed terminal 20 is formed as shown in FIG. 3, the form of the feed terminal 20 is not limited to that shown in FIG. 3. The feed terminal 20 may be constructed in an arbitrary form as long as the feed terminal 20 can be fixed via solder or the like to the circuit board 5 at the location facing the antenna rotation shaft 12 and the feed terminal 20 has elasticity that can provide an urging force that allows the feed terminal 20 to be maintained in contact with the antenna rotating shaft 12.

In the embodiment described above, only one part 18 is used to support the antenna rotating shaft. Alternatively, a plurality of parts 18 for supporting the antenna rotating shaft may be disposed at spaced locations such that the antenna rotating shaft 12 inserted in the inside of the card case 4 is supported at the plurality of locations by the plurality of parts 18.

In the card device according to the present invention, the feed terminal needs a small installation space, and a reduction in the production cost can be easily achieved. Thus, the present invention is suitable for mass production of a small-sized card device.

Although the present invention has been described in relation to particular embodiments thereof, many other variations and modifications and other uses will become apparent to those skilled in the art. Therefore, the present invention is not limited by the specific disclosure herein.

What is claimed is:

1. A card device with including an antenna feed terminal, comprising:

a card case comprising an upper cover, a lower cover, and a side wall connecting the upper cover with the lower cover, the side wall having a through-hole;

a circuit board affixed to the lower cover, positioned in an inner space of the card case, and including a circuit having an antenna connection part;

an antenna rotatably positioned on an outside of the card case and electrically connected to the circuit formed on the circuit board;

an antenna rotating shaft comprising a conductive material on a base end of the antenna from the outside into an inside of the card case in a direction along a surface of the circuit board the the antenna rotating shaft extending through the through-hole formed in the side wall of the card case;

a part for supporting the antenna rotating shaft positioned on an inner wall surface of the card case such that an inner portion of the antenna rotating shaft which is inside of the card case is supported within the card case in such a manner that the inner portion of the antenna rotating shaft is apart from the circuit board and is freely rotatable;

a feed terminal having elasticity positioned between the inner portion of the antenna rotating shaft located inside the card case and an area of the circuit board facing the inner portion of the antenna rotating shaft, such that the elasticity of the feed terminal provides an urging force against the inner portion of the antenna rotating shaft;

the feed terminal is fixed to the antenna connection part of the circuit of the circuit board and is positioned to face the antenna rotating shaft, such that the feed terminal is electrically connected to the circuit of the circuit board and to the antenna rotating shaft; and the feed terminal is urged by the urging force so as to be maintained in electrical contact with the antenna rotating shaft.

2. The card device according to claim 1, wherein the feed terminal is disposed between the side wall of the card case in which the through-hole for inserting the antenna rotating shaft is formed and the part for supporting the antenna rotating shaft such that the feed terminal is urged into contact with the inner portion of the antenna rotating shaft.

3. The card device according to claim 1, further comprising an antenna rotation position holding arrangement positioned and configured to hold an antenna rotation adjustment position by friction.

4. The card device according to claim 1, wherein the part for supporting the antenna rotation shaft is formed on an inner surface of the upper cover whereby the antenna rotating shaft is rotatably supported to the upper cover, the circuit board is fixed to the lower cover, and the feed terminal of the circuit board fixed to the lower cover is urged into contact with the antenna rotating shaft supported to the upper cover by securing together the lower cover and the upper cover.

5. The card device according to claim 1, wherein one of the upper cover and the lower cover includes an extending wall formed extending along an outer surface of a side wall of the other of the upper or lower cover, wherein a hook is formed on an end of the extending wall, a hook receiving part for receiving the hook to achieve a firm connection between the hook and the hook receiving part is formed on the other cover, and the upper cover and the lower cover are assembled by firmly engaging the hook of the one cover with the hook receiving part of the other cover.

* * * * *